US011035182B2

(12) United States Patent
Triadou et al.

(10) Patent No.: US 11,035,182 B2
(45) Date of Patent: Jun. 15, 2021

(54) CONNECTOR FOR ASSEMBLING TWO RISER SECTIONS WITH INTERNAL LOCKING RING

(71) Applicant: IFP Energies nouvelles, Rueil-Malmaison (FR)

(72) Inventors: Jeremie Triadou, Rueil-Malmaison (FR); Emmanuel Persent, Rueil-Malmaison (FR); Jerome Jouanin, Rueil-Malmaison (FR)

(73) Assignee: IFP Energies Nouvelles, Rueil-Malmaison (FR)

( * ) Notice: Subject to any disclaimer, the term of this patent is extended or adjusted under 35 U.S.C. 154(b) by 0 days.

(21) Appl. No.: 16/702,037

(22) Filed: Dec. 3, 2019

(65) Prior Publication Data

US 2020/0173239 A1 Jun. 4, 2020

(30) Foreign Application Priority Data

Dec. 4, 2018 (FR) ..... 18/72.305

(51) Int. Cl.
*E21B 17/08* (2006.01)

(52) U.S. Cl.
CPC ..... *E21B 17/085* (2013.01)

(58) Field of Classification Search
CPC ..... E21B 17/085; E21B 17/046; E21B 17/06; E21B 17/04
See application file for complete search history.

(56) References Cited

U.S. PATENT DOCUMENTS 10,704,341 B2 * 7/2020 Persent ..... E21B 17/046
10,822,887 B2 * 11/2020 Persent ..... E21B 17/085
2010/0319925 A1 12/2010 Papon et al.
2011/0203804 A1 8/2011 Guesnon et al.
2013/0020087 A1 1/2013 Guesnon et al.
2018/0363390 A1 * 12/2018 Persent ..... E21B 33/038
2019/0136642 A1 * 5/2019 Persent ..... F16L 37/113

FOREIGN PATENT DOCUMENTS

FR 2925105 A1 6/2009
FR 2956693 A1 8/2011
FR 2956694 A1 8/2011
FR 3045708 A1 6/2017
KR 2016 0085881 A 7/2016
WO WO-2012156004 A2 * 11/2012 ..... F16L 37/138
WO 2015/071411 A2 5/2015
WO 2015/169559 A1 11/2015
WO 2015/169560 A1 11/2015
WO 2017/102219 A1 6/2017
WO 2017/102220 A1 6/2017

OTHER PUBLICATIONS

Preliminary Search Report for FR 18/72.305, dated Sep. 19, 2019.

* cited by examiner

*Primary Examiner* — James G Sayre
(74) *Attorney, Agent, or Firm* — Fitch, Even, Tabin & Flannery, LLP

(57) ABSTRACT

The present invention relates to a compact connector design with an internal locking ring (11). The connector according to the invention comprises a locking ring (11) allowing bayonet type connection on either side with two riser sections. Furthermore, the connector comprises at least one removable pin (12) for translationally blocking locking ring (11), notably upon locking and unlocking. Removable pin (12) therefore cooperates with locking ring (11) by being arranged in a connector element (8, 9).

FIG. 2 to be published.

20 Claims, 6 Drawing Sheets

CONNECTOR FOR ASSEMBLING TWO RISER SECTIONS WITH INTERNAL LOCKING RING

CROSS REFERENCE TO RELATED APPLICATION

Reference is made to French Patent Application No. 18/72.305 filed Dec. 04, 2018, to which priority is claimed and which is incorporated herein by reference in its entirety.

FIELD OF THE INVENTION

The present invention relates to the field of deepwater oil drilling and reservoir development. It concerns a riser connector.

A drilling riser is made up of an assembly of tubular elements of length generally ranging between 15 and 27 m (50 and 90 feet), assembled by connectors. The tubular elements generally consist of a main tube provided with connectors at each end. Tubular auxiliary lines, also called peripheral lines, commonly referred to as "kill line", "choke line", "booster line" and "hydraulic line", allowing circulation of technical fluids, are provided parallel to the main tube. The tubular elements are assembled on the drilling site, from a floater. The riser is lowered into the water depth as the tubular elements are assembled, until it reaches the wellhead located on the sea bottom.

In the perspective of drilling at water depths that can reach 3500 m or more, the weight of the riser becomes very penalizing. This phenomenon is increased by the fact that, for the same maximum working pressure, the length of the riser requires a larger inside diameter for the auxiliary lines, considering the necessity to limit pressure drops.

Besides, the necessity to decrease the riser assembly time is all the more critical since the water depth, and therefore the riser length, is great.

A riser intended for other applications, notably production, completion or workover, also consists of an assembly of tubular elements assembled by connectors.

BACKGROUND OF THE INVENTION

Documents FR-2,925,105, FR-2,956,693 and FR-2,956,694 describe various solutions notably aiming to involve the auxiliary lines, together with the main tube, in the taking up of the longitudinal stresses applied to the riser. However, for the systems described in these patents, fastening of the auxiliary lines with respect to the main tube causes tensile stresses in the auxiliary lines. In order to withstand these tensile stresses, the auxiliary lines have great thickness values, which generates an increase in the mass and size of the floaters, and therefore in the cost of the riser. Another problem with these connectors concerns the inspection and maintenance of the locking ring. Indeed, the locking rings in the aforementioned patents are not fully removable. It is therefore not possible to inspect the entire locking ring.

To overcome this problem, patent applications WO-2015/071,411, WO-2015/169,560 and WO-2015/169,559 relate to connectors provided with locking rings removable by means of two bayonet connections. However, these three connectors require a particular stud layout to prevent simultaneous unlocking of the locking ring with the two riser sections.

The solution described in patent application FR-3,045,708 (WO-2017/102,220) allows both to facilitate inspection and maintenance of the locking ring, and to prevent simultaneous disconnection of the locking ring thanks to removable pins. This type of locking ring yields satisfactory results, it is however desirable to reduce the large number of connector components, to reduce the component machining cost and to improve sealing. Indeed, this solution can require a tubular sleeve for fitting the male connector element into the female connector element and for centering the locking ring in the connector elements. This sleeve is an additional part that requires additional machining and sealing, as well as an additional step upon assembly.

In order to overcome these drawbacks, the present invention relates to a compact connector design with an internal locking ring. The connector according to the invention comprises a locking ring allowing a bayonet type connection on either side with two riser sections. Besides, the connector comprises at least one removable pin for translationally blocking the locking ring, notably upon locking and unlocking. Thus, the connector according to the invention is removable, and simultaneous removal of the ring with the two riser sections is prevented. Besides, the locking ring comprises centering surfaces so as to achieve centering of the locking ring with respect to the connector elements of the sections.

SUMMARY OF THE INVENTION

The present invention relates to a connector for assembling two riser sections, comprising a first main tube element extended by a first connector element, a second main tube element extended by a second connector element, a locking ring comprising a first and a second series of studs on the outer surface thereof, said first and second connector elements respectively comprising on the inner surface thereof a third and a fourth series of studs respectively cooperating with said first and second series of studs for connecting said first and second main tube elements, said connector further comprising at least one removable pin. Said removable pin cooperates with said locking ring and it is arranged in said first connector element so as to translationally block said locking ring with respect to said first connector element.

According to an embodiment, said locking ring is centered in said first and second connector elements by means of a first and a second centering surface respectively provided on said locking ring.

Preferably, said connector comprises no sleeve fastened to one of said first or second connector element.

Advantageously, said locking ring comprises a first and a second sealing surface respectively arranged in said first and second connector elements.

Advantageously, the inside diameter of said locking ring is substantially identical to the inside diameter of said first and second main tube elements.

According to an implementation, said connector comprises a cylindrical sleeve mounted in the first connector element.

Preferably, said cylindrical sleeve comprises a bearing surface in contact with one end of said locking ring.

According to an aspect, said locking ring is symmetrical with respect to a median plane of said locking ring perpendicular to the axis of said locking ring.

According to a feature, said removable pin cooperates with a stud of said first series of studs of said locking ring in an unlocked position of said locking ring.

Advantageously, said removable pin comprises a plane surface for cooperating with said stud of said first series of studs of said locking ring.

According to an embodiment, said removable pin is arranged in an orifice of said first connector element.

Advantageously, said removable pin comprises a guide lug.

According to an implementation, said connector comprises means for rotationally blocking said locking ring.

Preferably, said means for rotationally blocking said locking ring comprise a system with an index pin, said index pin being preferably radial or axial.

According to an embodiment, said connector comprises means for rotationally blocking said first and second connector elements.

Preferably, said means for rotationally blocking said first and second connector elements comprise two stops on each connector element, a stop of a connector element cooperating with a stop of the other connector element.

Advantageously, said index pin of said means for rotationally blocking the locking ring is included in a stop of said means for rotationally blocking said first and second connector elements.

According to an aspect, the studs of said first and second series of studs project over identical angular ranges.

According to a feature, said first and second connector elements are respectively provided with a flange for respective passage of a first and a second auxiliary tube element.

Furthermore, the invention relates to a riser comprising at least two riser sections assembled by a connector according to one of the above features.

Besides, the invention relates to a use of a riser according to the previous feature for performing offshore well drilling or workover or production operations.

BRIEF DESCRIPTION OF THE FIGURES

Other features and advantages of the connector according to the invention will be clear from reading the description hereafter of embodiments given by way of non-limitative example, with reference to the accompanying figures wherein.

DETAILED DESCRIPTION OF THE INVENTION

Figure 1:
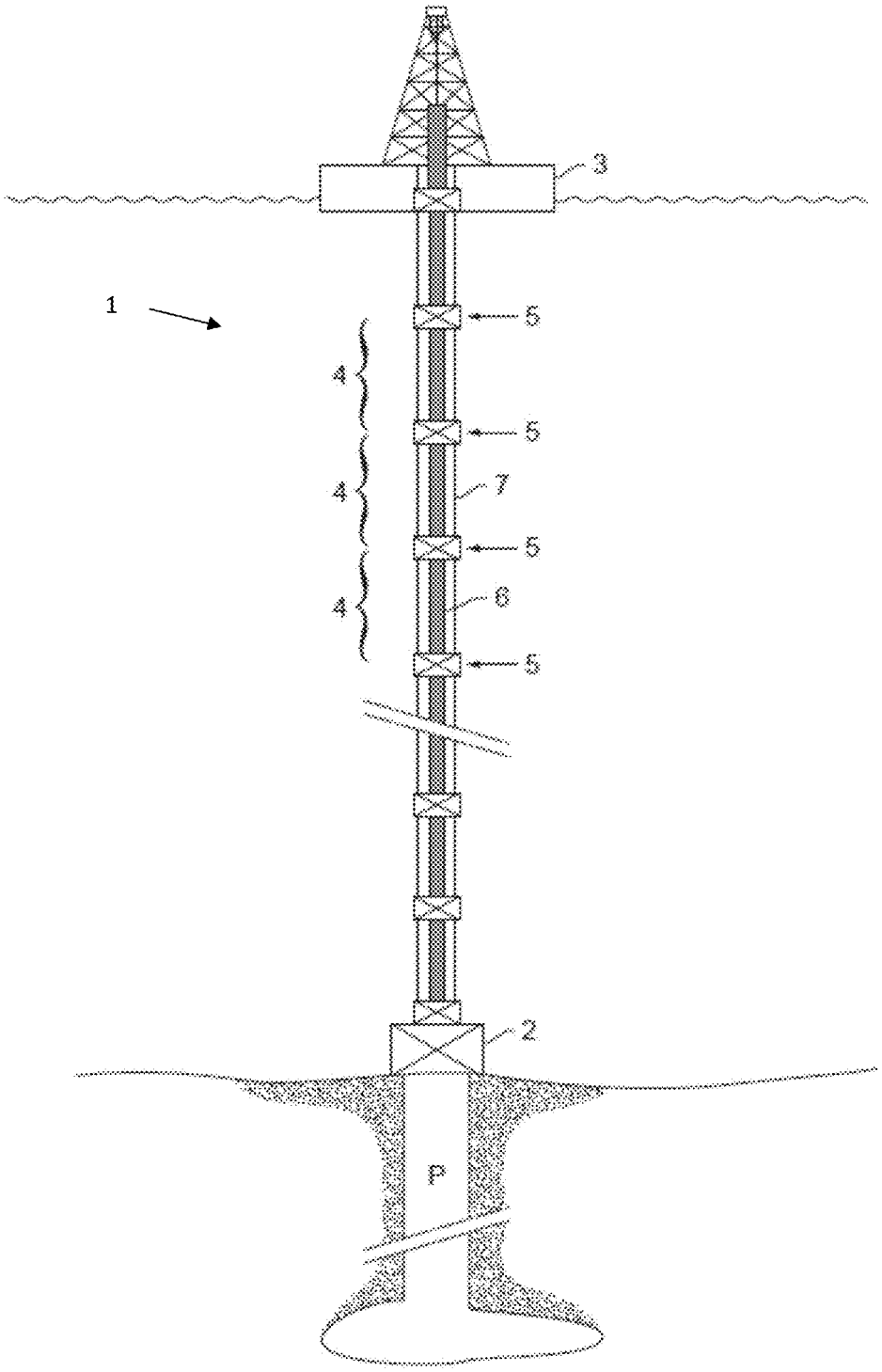
FIG. 1 schematically shows a riser according to the invention.

According to a non-limitative example embodiment, FIG. 1 schematically shows an offshore drilling riser 1. Riser 1 extends well P and it stretches from wellhead 2 to a floater 3, a platform or a vessel for example. Wellhead 2 is provided with a preventer commonly referred to as "B.O.P." or "Blow-Out Preventer". Riser 1 is made up of an assembly of several sections 4 assembled end to end by connectors 5. Each section consists of a main tube element 6 provided with at least one auxiliary line element 7, also referred to as peripheral line. Several auxiliary lines are generally used, among which notably kill lines, choke lines, booster lines and hydraulic lines. The auxiliary lines referred to as kill lines or choke lines are used to provide well safety during control procedures relative to the inflow of fluids under pressure in the well. The line referred to as choke line is a safety line carrying fluids (oil, water, gas) coming from the well in the event of an inflow and driving them towards the choke manifold and the flare. The line referred to as kill line is a safety line enabling injection into the well of heavy fluids and cements allowing an otherwise uncontrollable blowout to be stopped. The auxiliary line referred to as booster line allows mud to be injected into the well in order to increase the annulus velocity thereof and to prevent sedimentation of the cuttings; it is also used for replacing the mud contained in the riser with water prior to disconnection. The line referred to as hydraulic line allows the wellhead preventer to be controlled. Hydraulic lines allow the BOP safety devices (valves and accumulators) to be supplied with hydraulic fluid (glycol-laden distilled water) under pressure.

Section 4 comprises a main tube element 6 whose axis forms the axis of the riser. Auxiliary tubes 7 make up auxiliary lines or tubes arranged parallel to the axis of the main tube. Auxiliary tube elements 7 have lengths substantially equal to the length of main tube element 6, generally ranging between 10 and 30 meters. At least one line 7 is arranged on the periphery of the main tube.

A connector 5 shown in FIG. 1 consists of two connector elements (not shown). The connector elements are mounted at the ends of main tube element 6. The connector elements are secured to main tube elements 6, for example by welding, by screwing, by crimping or by clamping linkage. The assembly of a connector element of a section 4 with a connector element of another section 4 forms connector 5 that transmits stresses from a riser section to the next section, notably the longitudinal stresses undergone by the riser.

The connector according to the invention is suited for a drilling riser, for example as described in connection with FIG. 1, but the connector according to the invention can also be suited for a completion, workover or production riser, whose particular feature is notably to have no auxiliary line. According to the invention, the connector comprises:

- a first main tube element extended by a first connector element, which can be optionally provided with guide means (a first flange for example) for passage of an auxiliary tube element (in cases where the riser comprises at least one auxiliary line),
- a second main tube element extended by a second connector element, which can be optionally provided with guide means (a second flange for example) for passage of an auxiliary tube element (in cases where the riser comprises at least one auxiliary line),
- optionally a first auxiliary tube element passing through the first flange,
- optionally a second auxiliary tube element passing through the second flange,
- a locking ring, referred to as internal locking ring, arranged within the connector elements, the locking ring comprising, on the outer face thereof, a first series and a second series of studs suited to cooperate with a third series and a fourth series of studs respectively arranged on inner surfaces of the first and second connector elements, so as to connect the first and the second main tube elements, and at least one removable pin, the removable pin cooperating with the locking ring and being arranged in the first connector element so as to translationally block the locking ring with respect to the first connector element, and the removable pin can notably cooperate with a stud of the first series of studs of the locking ring or any other element provided on the locking ring.

Thus, by means of the four series of studs, two bayonet type connections are formed: a first one between the locking ring and the first connector element, and a second one between the locking ring and the second connector element. The locking ring is thus made removable with respect to the connector elements, which allows inspection and maintenance thereof. Moreover, bayonet connections enable fast locking and unlocking of the connector.

Arranging the ring inside the two connector elements allows to reduce the size of the connector and thus provides connector compactness.

Furthermore, the arrangement of the removable pin (in the first connector element and cooperating with the studs of the locking ring) avoids having a component within the locking ring to fulfil the function of translationally blocking the locking ring with respect to the first connector element. In patent application FR-3,045,708 (WO-2017/102,220), this function is fulfilled by a pin running through the locking ring and into a groove or an orifice of the male connector element, which can comprise a sleeve.

The connector can be designed and dimensioned so as to meet the specifications mentioned by the API 16 R and API 2 RD standards edited by the American Petroleum Institute.

The various embodiments described above and hereafter can be combined so as to combine the effects thereof.

According to an embodiment of the invention, the locking ring can further comprise, on the outer surface thereof, a first and a second centering surface. The first centering surface is intended for centering of the locking ring in the first connector element, and the second centering surface is intended for centering of the locking ring in the second connector element. Thus, the locking ring fulfils both a locking function and a centering function. The connector therefore comprises no additional element fulfilling notably the centering function, in particular no sleeve fastened to a connector element. In other words, the connector requires no sleeve, which allows to limit the number of connector components, which in turn limits machining of the components and simplifies connector assembly. Furthermore, this connector design enables to have a thicker ring, thus limiting mechanical stresses and/or the outside diameter of the connector and providing higher rigidity upon connection. Besides, this configuration of the locking ring allows to use identical connector elements, which also simplifies manufacture of the components. Preferably, the centering surfaces can consist of cylindrical surfaces. Advantageously, the centering surfaces can be arranged at the longitudinal ends of the locking ring. This maximum distance allows centering to be optimized.

According to an aspect of this embodiment of the invention, the locking ring can comprise, on the outer surface thereof, a first and a second sealing surface. The first sealing surface is intended to provide sealing between the locking ring and the first connector element, and the second sealing surface is intended to provide sealing between the locking ring and the second connector element. Preferably, the sealing surfaces can be arranged between the centering surfaces and the series of studs. In other words, for this embodiment, the outer surface of the locking ring can comprise, in the longitudinal direction, a first centering surface, a first sealing surface, a first series of studs, a second series of studs, a second sealing surface and a second centering surface. Preferably, the sealing surfaces are cylindrical surfaces. Advantageously, the outside diameter of the sealing surfaces is greater than the diameter of the centering surfaces. Seals can be provided in grooves of the connector elements, the seals are then in contact with the sealing surfaces of the locking ring. Alternatively, seals can be provided in grooves of the locking ring at the sealing surfaces, the seals are then in contact with the inner surface of the connector elements.

According to an implementation of this embodiment of the invention (rings with centering surfaces), the inside diameter of the locking ring can be substantially identical to the inside diameter of the first and second connector elements, whose diameter is substantially identical to the diameters of the first and second main tube elements. This implementation allows to avoid pressure drops in the main tube thanks to a substantially constant inside diameter of the main tube.

Alternatively, the connector can comprise a cylindrical sleeve. The cylindrical sleeve can be mounted on one of the connector elements (the first connector element for example) and it can be inserted into the other connector element (the second connector element for example). The locking ring is then arranged around the sleeve. The cylindrical sleeve can be assembled to the first connector element by bolting, screwing, shrink fitting, using circlips or any similar means. Alternatively, the cylindrical sleeve can rest on the upper bearing surface of the locking ring. In other words, the cylindrical sleeve can rest on the axial end of the locking ring that is inserted in the first connector element. According to an example embodiment, a shoulder can be provided on the outer surface of the sleeve so as to create a bearing surface. The cylindrical sleeve further allows notably centering and sealing functions to be fulfilled.

According to an embodiment of the invention, the studs of the first and second series of studs (and a fortiori of the third and fourth series of studs) project over identical angular ranges. The angular range of a stud is understood to be the angle formed by the disc portion occupied by the stud on the diameter in which it is inscribed. For example, if a series of studs comprises studs representing each one sixth of a disc, then the angular range of the stud is 60°. Thus, by means of this design, locking and unlocking of the locking ring with respect to the two connector elements can result from a single rotation and it becomes simultaneous. The locking ring is therefore rotated only between two angular positions.

According to a first implementation of the invention, the circumferential distributions of the first and second series of studs are symmetrical with respect to a radial plane passing between the two series of studs. In other words, the studs of the first and second series of studs face each other (are aligned). Thus, the locking ring can be symmetrical with respect to a median plane of the locking ring, the plane being perpendicular to the axis of the locking ring. This symmetrical design notably allows the assembly and the manufacture of the locking ring to be simplified. According to a second implementation of the invention, the circumferential distributions of the first and second series of studs are opposite each other: the circumferential distribution of the second series of studs is offset with respect to the first series of studs, by an angle corresponding to the angular range of a stud. In other words, the studs of a series face the intervals of the other series. According to a third implementation of the invention, the circumferential distributions of the studs of the first and second series are offset with respect to one another, by an angle corresponding to half the angular range of a stud (or any other angle).

Alternatively, the studs of the first and second series of studs (and a fortiori of the third and fourth series of studs) project over different angular ranges. Thus, unlocking of the two bayonet connections is achieved by distinct rotations.

Preferably, the locking ring can be made in a single piece.

The purpose of the removable pin(s) is to support the weight of the locking ring in unlocked position. Preferably, they are set upon assembly and they are removed only for inspection.

Advantageously, when the removable pin is intended to be in contact with a stud of the locking ring, the removable pin can comprise a plane surface for cooperation with a stud of the locking ring. Contact is thus facilitated, which enables simple translational blocking.

Advantageously, the removable pin can be arranged in an orifice of the connector element. The orifice is preferably radial. The orifice can be provided between the flange and the end of the first connector element facing the second connector element.

Furthermore, in order to facilitate insertion and positioning of the removable pin, the removable pin can comprise a guide lug. In other words, the removable pin has a specific shape allowing the removable pin to be correctly positioned.

According to an embodiment of the invention, the locking means comprise a plurality of removable pins. It is thus possible to distribute the stresses among the removable pins. For this embodiment, a number of removable pins corresponding to the number of studs of the third series or of the fourth series of studs (a fortiori of the first or of the third series of studs) can be provided. Alternatively, a number of removable pins substantially corresponding to half the number of studs of the third or of the fourth series of studs can be provided. This alternative allows to obtain a compromise between the number of pins and the stresses exerted on the pins.

According to an embodiment of the invention, each series of studs can comprise at least one row of studs. A row of studs is understood to be a circumferential distribution of the studs. Each row of studs has an alternation of projecting studs and of void spaces (intervals), these void spaces allowing passage of the corresponding studs of the series of studs with which the row of studs cooperates.

According to an implementation of the invention, the series of studs can comprise a plurality of rows of studs, in particular two or three rows of studs. The plurality of rows of studs allows the axial loads on the studs to be decreased, which allows to limit the mechanical fatigue of the studs.

According to a possible design, each series of studs comprises a single row of studs. According to a first alternative, each series of studs comprises two rows of studs. According to a second alternative, each series of studs comprises three rows of studs. According to a third alternative, two of the four series of studs comprise one row of studs and the other two series comprise two rows of studs. According to a fourth alternative, two of the four series of studs comprise two rows of studs and the other two series comprise three rows of studs.

In cases where a series of studs comprises several rows of studs, then the rows of studs can be inscribed in different diameters. This design allows to pass the row of studs of smaller diameter, and it is thus possible to lock and unlock the bayonet connection with a single rotation.

In cases where a series of studs comprises several rows of studs, then the rows of studs can be inscribed in identical diameters. This design requires insertion and locking of the bayonet connection by a relative motion consisting of a first translation, a first rotation, a second translation and a second rotation. This design thus allows better connection security because it avoids unwanted disconnection.

Each row of studs comprises a plurality of studs evenly distributed over a diameter. Advantageously, the studs of the various rows can be arranged to allow 360° locking. According to a design, the rows of studs can comprise three studs having an angular range of 60°, or 40°. According to an alternative, the rows of studs can comprise four studs having an angular range of 45°, or 30°. According to an alternative, the rows of studs can comprise five studs having an angular range of 36°, or 24°. According to another alternative, the rows of studs can comprise six studs having an angular range of 30°, or 20°. According to an alternative, the rows of studs can comprise eight studs having an angular range of 22.5°, or 15°. In order to have the studs projecting over identical angular ranges, all the rows of all the series of studs can comprise the same number of studs.

Furthermore, according to a connector design, the ring can comprise means for rotationally blocking the connector elements, stops for example. For this embodiment, the means for rotationally blocking the locking ring can comprise two stops on each connector element, the stops of the first connector element cooperating with the stops of the second connector element. The stops can also be called dogs or abutments On one of the connector elements, the stops can have substantially the shape of an L, preferably an elongate L, and on the other connector element the stops can have substantially the shape of a T, preferably a T whose vertical bar dimension is equivalent to half the horizontal bar of the T. Each cooperating stop pair allows to prevent a direction of rotation of the connector elements. For example, the vertical bar of the T of the stops of the first connector element comes into contact with the smaller part of the L of the stops of the second connector element. Alternatively, the stops can have other shapes, such as right angles, concave and convex surfaces, etc.

Advantageously, the stops can be removable. This solution enables fast and inexpensive replacement upon maintenance, as well as use of identical connector elements. In this case, they can be fixed with screws on the connector elements. Alternatively, the stops are machined in the flanges of the connector elements. This alternative can also allow to use identical connector elements.

According to a feature of the invention, the connector can comprise means for blocking the locking ring in at least one position, notably in locked position. These blocking means can also allow to prevent rotation of the locking ring with respect to the first connector element in the unlocked position. The means for blocking the locking ring allow to avoid any unwanted unlocking of the locking ring.

According to an example of this embodiment, the means for rotationally blocking the locking ring can comprise a system with an index pin (i.e. a pin fitting in an orifice when it is in blocking position). The index pin can be axial or radial. Such a system affords the advantage of being automatic.

According to an implementation of the invention, the system can combine the two variants described above. The index pin of the means for rotationally blocking the locking ring can be inserted in one of the stops of the means for rotationally blocking the connector elements. This combination allows to engage the two blocking means one inside the other, which limits the number of components, and facilitates maintenance and inspection operations.

According to a design of the invention, the locking ring can include handling means external to the locking ring. These handling means allow the locking ring to be rotated. For example, the handling means can be a handling bar. According to a design, the handling means can be inserted in a removable pin.

According to an embodiment, the locking ring can be a one-piece ring, which simplifies design and assembly of the connector.

Figure 2:
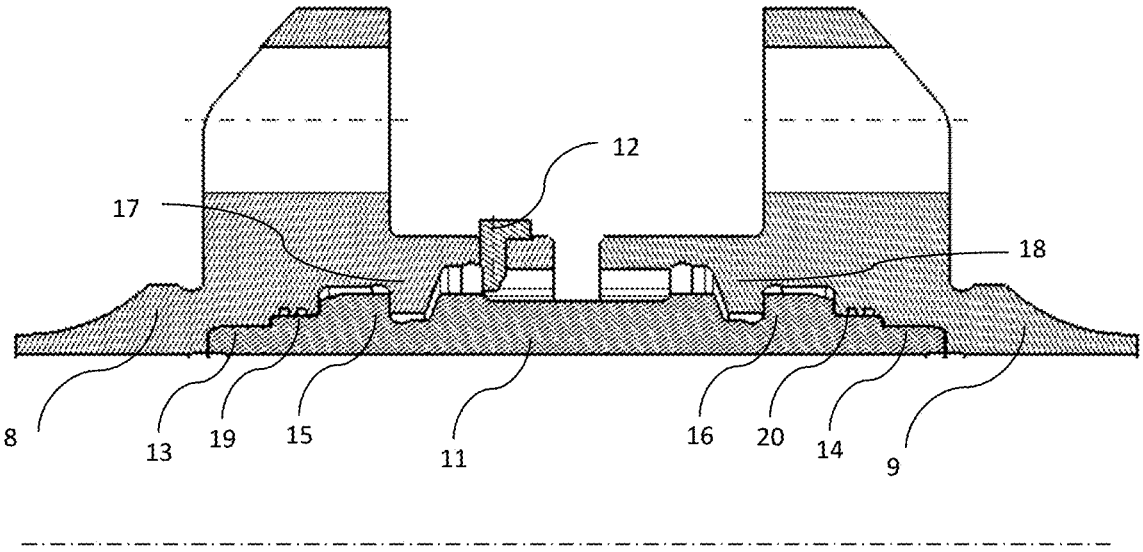
FIG. 2 illustrates a connector according to a first variant embodiment of the invention.

FIG. 2 schematically illustrates, by way of non-limitative example, a connector according to a first variant embodiment of the invention, the connector assembling two riser sections. FIG. 2 corresponds to a sectional view of the connector. In this figure, only one side of the sectional view is shown, the second side can be deduced by axial symmetry. The axis of the sections and of the connector is represented horizontally. In this figure, the flanges for the auxiliary tube elements are shown, but they are not necessary to the connector according to the invention. A first connector element 8 is connected to a second connector element 9. Locking means achieve and lock the assembly. The locking means comprise a locking ring 11. Locking ring 11 comprises, on the outer surface thereof, a first series of studs 15 and a second series of studs 16. First series of studs 15 cooperates with a third series of studs 17 arranged on the inner surface of first connector element 8. Second series of studs 16 cooperates with a fourth series of studs 18 arranged on the inner surface of second connector element 9. Besides, the locking means comprise at least one removable pin 12. Removable pin 12 cooperates with locking ring 11. Removable pin 12 is inserted in first connector element 8 so as to project on the inner part of first connector element 8. Locking ring 11 further comprises two centering surfaces 13 and 14 at the longitudinal ends of locking ring 11. First centering surface 13 allows centering of locking ring 11 with respect to first connector element 8. Second centering surface 14 allows centering of locking ring 11 with respect to second connector element 9. Furthermore, locking ring 11 comprises two sealing surfaces 19 and 20, these sealing surfaces 19 and 20 being located between centering surfaces 13 and 14 and series of studs 15 and 16.

Figure 3:
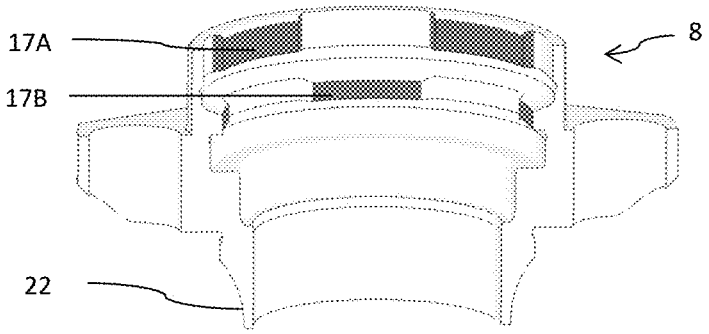
FIG. 3 illustrates a connector element according to an embodiment of the invention.

FIG. 3 schematically illustrates, by way of non-limitative example, in cross-sectional view, a connector element 8 or 9 for the embodiment of FIG. 2. Connector element 8 or 9 is a substantially cylindrical part comprising a first end 22 intended to be fastened to a main tube element (not shown). Connector element 8 or 9 comprises, on the inner face thereof, a third series of studs consisting of two rows of studs 17A and 17B. Row 17A is the most central row of the connector. According to the embodiment illustrated, each row of studs 17A, 17B comprises four studs having an angular range of 45°. The two rows of studs 17A, 17B are inscribed in different diameters. Insertion and locking in the locking ring (and conversely, unlocking and removal) is thus enabled with a single translation. Furthermore, the circumferential distributions of the studs of rows 17A, 17B are alternated: the studs of row 17A face (are aligned with) the intervals between two studs of row 17B and vice versa. By way of non-limitative example, this figure schematically shows the shape of the flange allowing passage of auxiliary tube elements. Besides, connector element 8 or 9 comprises inner bores for reception of the centering and sealing surfaces of the locking ring respectively.

Figure 4:
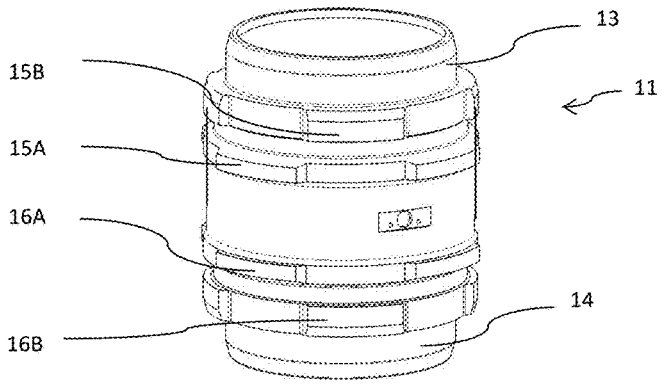
FIG. 4 illustrates a locking ring according to an embodiment of the invention.

FIG. 4 schematically illustrates, by way of non-limitative example, a locking ring 11 for the embodiment of FIG. 2. Locking ring 11 is a substantially cylindrical part. Locking ring 11 comprises, on the outer surface thereof, a first series of studs 15 and a second series of studs 16. First series of studs 15 is suited to cooperate with the third series of studs of the first connector element. Second series of studs 16 is suited to cooperate with the fourth series of studs of the second connector element. According to the embodiment illustrated, each series of studs 15, 16 comprises two rows of studs 15A, 15B and 16A, 16B. Rows 15A and 16A are the most central rows of studs. Each row of studs comprises four studs having an angular range of 45°. In the example illustrated, the studs of the central rows of studs 15A, 16A are inscribed in smaller diameters than the diameters of outer rows of studs 15B, 16B. Furthermore, the circumferential distributions of the studs of rows 15A, 15B are alternated: the studs of row 15A face (are aligned with) the intervals between two studs of row 15B and vice versa. Similarly, the circumferential distributions of the studs of rows 16A, 16B are alternated: the studs of row 16A face (are aligned with) the intervals between two studs of row 16B and vice versa. Besides, for the embodiment illustrated, the circumferential distributions of the studs of the first and third series are symmetrical with respect to a radial plane between the first and third series of studs: the studs of row 15A face (are aligned with) the studs of row 16A, and the studs of row 15B face (are aligned with) the studs of row 16B. Locking ring 11 also comprises at these ends two cylindrical centering surfaces 13, 14 and possibly two cylindrical sealing surfaces (not shown), the sealing surfaces being respectively arranged between one of the centering surfaces 13 or 14 and a series of studs 15 or 16.

Figure 6:
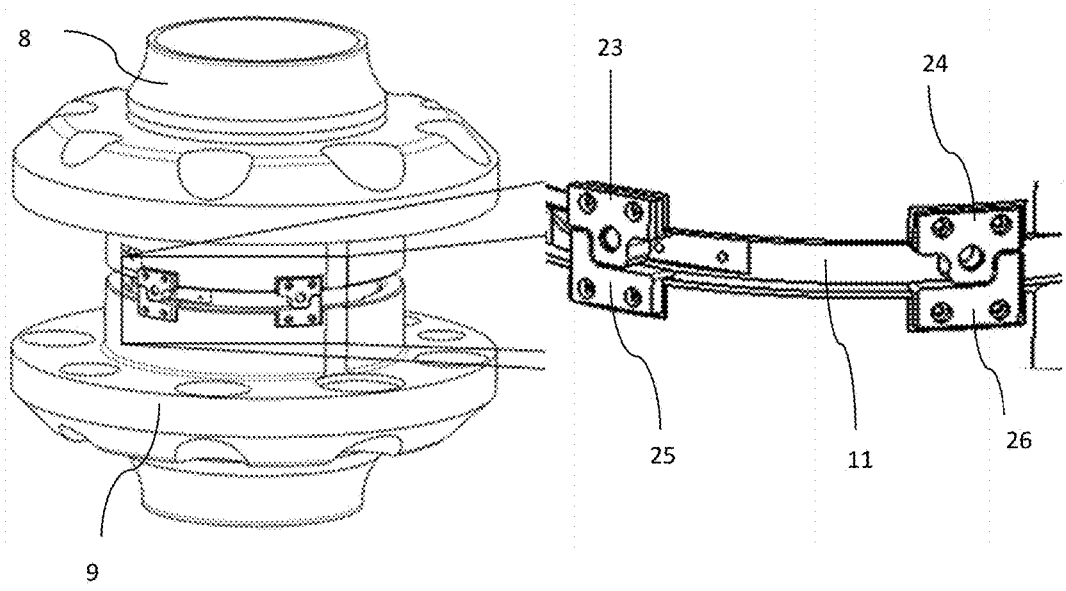
FIG. 6 illustrates means for rotationally blocking the connector elements according to a first embodiment of the invention.

FIG. 6 schematically illustrates, by way of non-limitative example, two assembled connector elements equipped with means for rotationally blocking the connector elements according to a first embodiment of the blocking means. The right-hand side of FIG. 6 is an enlargement of the means for rotationally blocking the connector elements. First connector element 8 comprises, on the outer surface and at the end thereof, two stops 23 and 24. Stops 23 and 24 are substantially T-shaped, the vertical bar of the T having a dimension similar to half the length of the horizontal bar of the T. Stops 23 and 24 can be removable: they are fastened by screws to first connector element 8. Second connector element 9 comprises, on the outer surface and at the end thereof, two stops 25 and 26. Stops 25 and 26 substantially have the shape of an elongate L. Stops 25 and 26 can be arranged in opposite positions. Stops 25 and 26 are removable: they are fastened by screws to second connector element 9. Stop 23 cooperates with stop 25 so as to block rotation in a direction of rotation (clockwise direction). Stop 24 cooperates with stop 26 so as to block rotation in the opposite direction of rotation (anticlockwise direction). The contacting surfaces of stops 23, 24, 25 and 26 (in the case illustrated, the vertical bar of the T and the smaller side of the L) project from connector elements 8 and 9 in the axial direction thereof, at the interval between the two connector elements 8 and 9, which makes part of the outer surface of locking ring 11 accessible.

Figure 7:
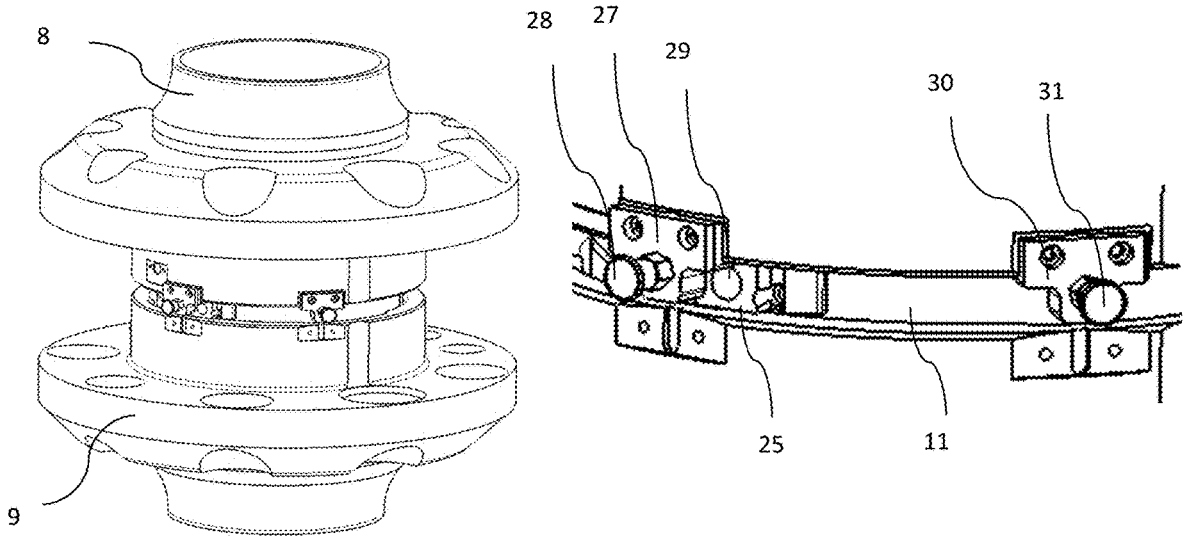
FIG. 7 illustrates means for rotationally blocking the locking ring according to a first embodiment.

FIG. 7 schematically illustrates, by way of non-limitative example, two assembled connector elements equipped with means for rotationally blocking the locking ring according to a first variant embodiment. The right-hand side of FIG. 7 is an enlargement of the means for rotationally blocking the locking ring. First connector element 8 comprises, on the outer surface and at the end thereof, two supports 27 and 30 for index pins 28 and 31. For the embodiment illustrated, index pins 28 and 31 have a radial direction. Index pins 28 and 31 are intended to engage into orifices provided on a support of locking ring 11, such as orifice 29. Supports 27 and 30 are removable: they are fastened by screws to first connector element 8. Supports 27 and 30 project from connector element 8 in the axial direction thereof, at the interval between the two connector elements 8 and 9, which makes part of the outer surface of locking ring 11 accessible.

FIG. 7 illustrates means for rotationally blocking the locking ring that are independent of the means for rotationally blocking the connector elements. However, the means for blocking the locking ring can be included in the means for blocking the connector elements. In this case, supports 27 and 30 can correspond to stops 23 and 24 in which orifices can be provided for passage of index pins 28 and 31. In the present case, the orifices can be provided in the vertical bar of the T of stops 23 and 24.

Figure 8:
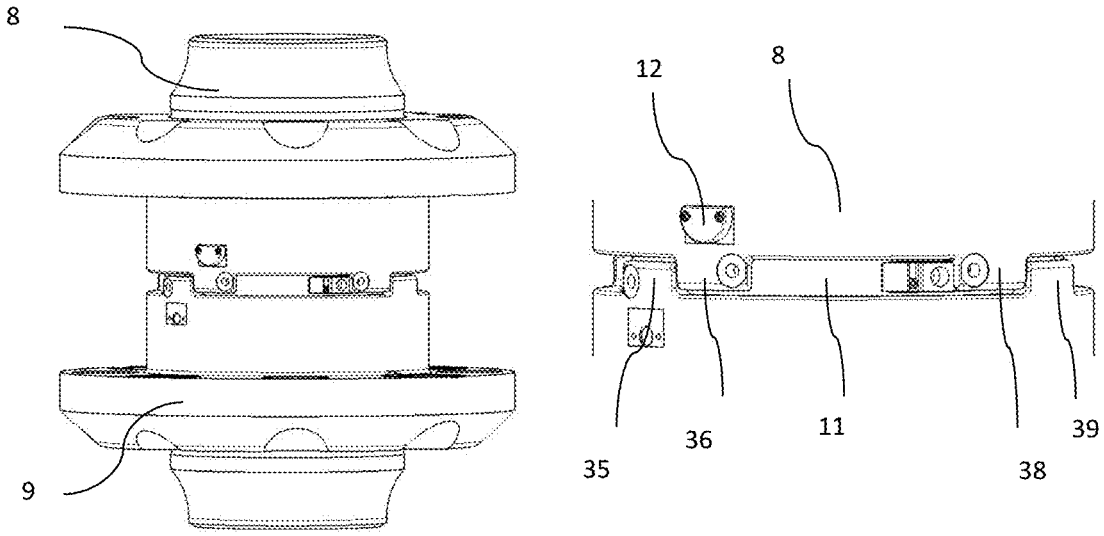
FIG. 8 illustrates means for rotationally blocking the connector elements according to a second embodiment of the invention.

FIG. 8 schematically illustrates, by way of non-limitative example, two assembled connector elements equipped with means for rotationally blocking the connector elements according to a second embodiment of the means for rotationally blocking the connector elements. The right-hand side of FIG. 8 is an enlargement of the means for rotationally blocking the connector elements. First connector element 8 comprises, on the outer surface and at the end thereof, two stops 36 and 38.

Stops 36 and 38 project in the axial direction of first connector element 8. Second connector element 9 comprises, on the outer surface and at the end thereof, two stops 35 and 39. Stops 35 and 39 project in the axial direction of second connector element 9. Stop 35 cooperates with stop 36 so as to block rotation in a direction of rotation (clockwise direction). Stop 38 cooperates with stop 39 so as to block rotation in the opposite direction of rotation (anticlockwise direction). The contacting surfaces of stops 35, 36, 38 and 39 project from connector elements 8 and 9 in the axial direction thereof, at the interval between the two connector elements 8 and 9, which makes part of the outer surface of locking ring 11 accessible. According to an example embodiment and as illustrated, a removable pin 12 can be provided above a projection 36 or 38.

Figure 9:
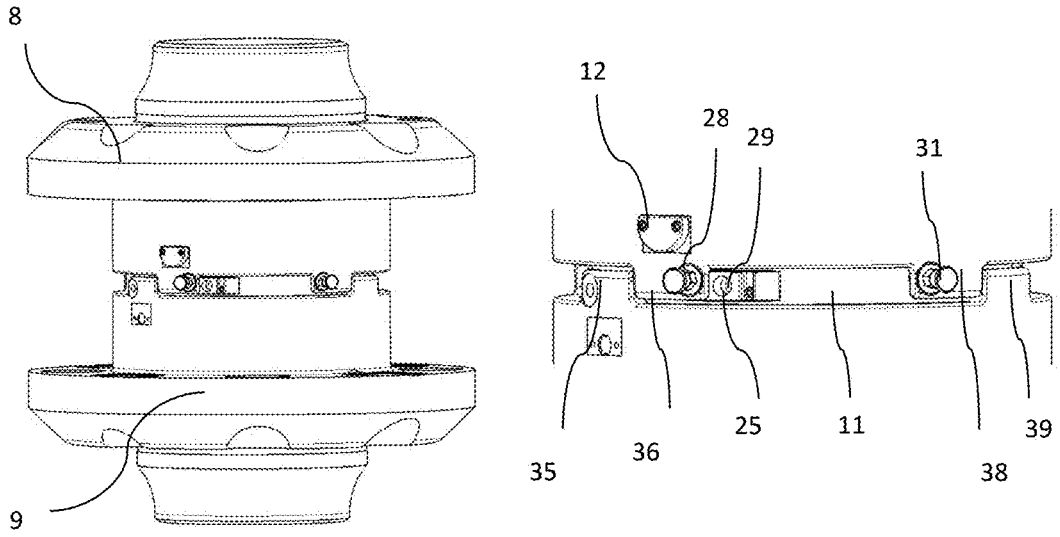
FIG. 9 illustrates means for rotationally blocking the locking ring according to a second embodiment.

FIG. 9 schematically illustrates, by way of non-limitative example, two assembled connector elements equipped with means for rotationally blocking the locking ring, included in a means for rotationally blocking the connector elements according to a second variant embodiment. The right-hand side of FIG. 9 is an enlargement of the means for rotationally blocking the locking ring. The means for rotationally blocking the connector elements correspond to those described in connection with FIG. 8. First connector element 8 comprises, on the outer surface and at the end thereof, two stops 36 and 38. Stops 36 and 38 project in the axial direction of first connector element 8. Second connector element 9 comprises, on the outer surface and at the end thereof, two stops 35 and 39. Stops 35 and 39 project in the axial direction of second connector element 9. Furthermore, stops 36 and 38 of first connector element 8 form two supports for index pins 28 and 31: stops 36 and 38 comprise orifices for passage of index pins 28 and 31. For the embodiment illustrated, index pins 28 and 31 have a radial direction. Index pins 28 and 31 are intended to engage into orifices provided on a support 25 of locking ring 11, such as orifice 29. According to an example embodiment and as illustrated, a removable pin 12 can be provided above a projection 36 or 38.

Figure 10:
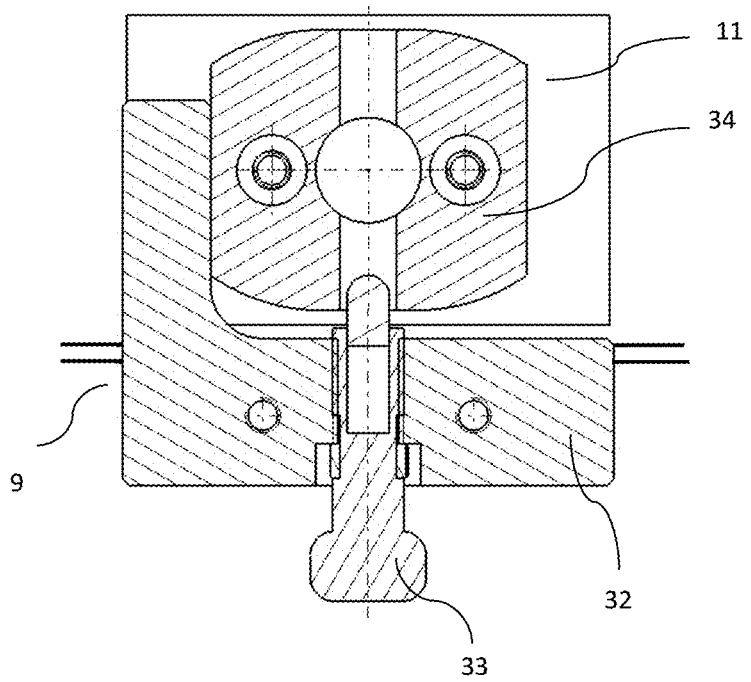
FIG. 10 illustrates means for rotationally blocking the locking ring according to a third embodiment.

According to an alternative to FIG. 10, the connector can comprise means for rotationally blocking the locking ring that are disjoint from the means for rotationally blocking the connector elements, or the connector can comprise only means for rotationally blocking the locking ring. In both cases, the first connector element comprises two axial projections at the end thereof, in which two index pins 33 are inserted.

FIG. 10 schematically illustrates, by way of non-limitative example, means for rotationally blocking the locking ring according to a second variant embodiment. Second connector element 9 comprises, on the outer surface and at the end thereof, a support 32 for an index pin 33. Index pin 33 has an axial direction. Index pin 33 is intended to engage into an orifice of a support 34 fastened to locking ring 11. Supports 32 and 34 are removably fastened by screwing.

FIG. 10 illustrates means for rotationally blocking the locking ring that are independent of the means for rotationally blocking the connector elements. However, the means for blocking the locking ring can be included in the means for blocking the connector elements. In this case, support 32 can correspond to stop 25 in which an orifice can be provided for passage of index pin 33.

Figure 11:
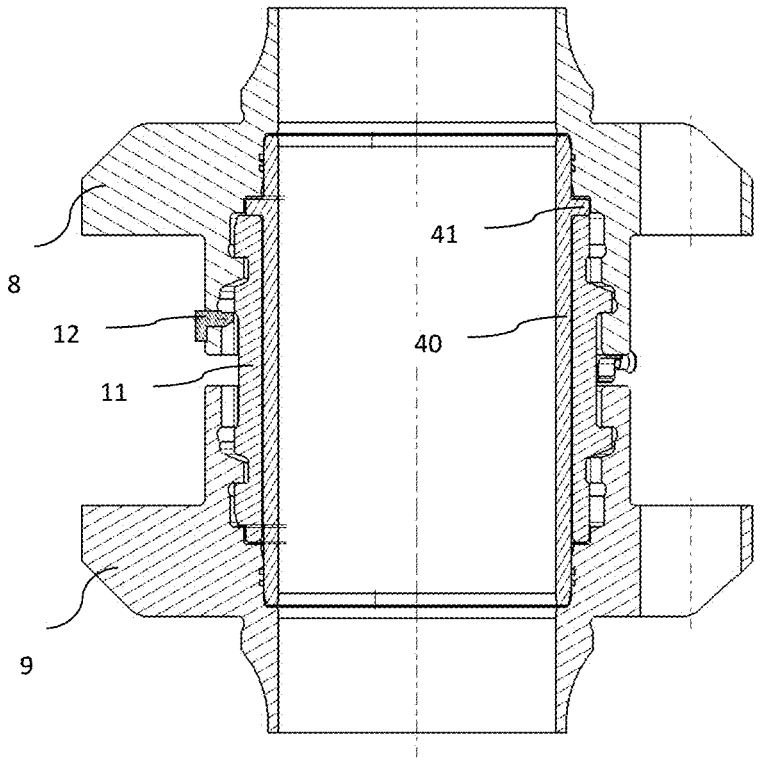
FIG. 11 illustrates a connector according to a second variant embodiment of the invention.

FIG. 11 schematically illustrates, by way of non-limitative example, a connector according to a second variant embodiment of the invention. FIG. 11 corresponds to a cross-sectional view of the connector. In this figure, the flanges for the auxiliary tube elements are shown, but they are not necessary to the connector according to the invention. A first connector element 8 is connected to a second connector element 9. Locking means achieve and lock the assembly. The locking means comprise a locking ring 11. The bayonet connections (with the series of studs) between locking ring 11 and connector elements 8 and 9 are identical to those of FIG. 2 and are therefore not described in detail. Besides, the locking means comprise at least one removable pin 12. Removable pin 12 cooperates with locking ring 11. Removable pin 12 is inserted in first connector element 8 so as to project on the inner part of first connector element 8. The connector further comprises a cylindrical sleeve 40. Cylindrical sleeve 40 is inserted in connector elements 8 and 9. The inside diameter of cylindrical sleeve 40 is substantially identical to the inside diameters of connector elements 8 and 9 so as to limit pressure drops. Locking ring 11 is arranged around cylindrical sleeve 40. Besides, the cylindrical sleeve comprises a shoulder 41 serving as a bearing surface between the cylindrical sleeve and an axial end of locking ring 11.

Furthermore, the present invention relates to a riser comprising at least two riser sections assembled by a connector as described above. The connector can be made according to any combination of the embodiments described above: plurality of removable pins, plurality of rows of studs, rows of studs inscribed in identical or distinct diameters, means for rotationally blocking the locking ring, means for rotationally blocking the connector elements, locking ring provided with sealing surfaces, locking ring symmetry, etc.

Moreover, the present invention relates to the use of such a riser (with any combination of the embodiments described above) for performing offshore drilling, effluent production or workover operations.

Besides, the present invention relates to a method of assembling two riser sections by means of a connector according to the invention. The following steps can be carried out for this method:

a) inserting the locking ring into a first connector element, thus the first main tube element is positioned in the locking ring without being locked, b) inserting at least one removable pin into the first connector element until it comes into contact with a stud of the locking ring, thus the first main tube element is positioned in the locking ring while being translationally blocked and it still has a rotating motion, it is therefore not locked, c) inserting the locking ring into the second connector element, thus the second main tube element is positioned in the locking ring without being locked, and d) locking the locking ring by rotating the locking ring, this single rotation locks the two connector elements that have no more relative motion with respect to the locking ring.

For step d), upon locking, rotation of the ring generates the respective cooperation of the first and third series of studs, and of the second and fourth series of studs. The rotation enabling simultaneous locking of the two bayonet type connections is a rotation by an angle corresponding to the angular range of the studs. For example, if the angular range of the studs is 36°, the locking rotation is a 36° rotation.

For step b), axial translation blocking of the first main tube element with respect to the locking ring is achieved in the two axial directions by contact of the removable pin(s) with studs of the locking ring.

The insertion steps consist in setting the locking ring in the connector element concerned, so that a single subsequent rotation allows the connector to be locked.

In some cases, the insertion steps correspond to a single relative translational motion of the ring with respect to the connector element. This is for example the case when the series of studs concerned only comprises one row of studs, or when the series of studs concerned comprises a plurality of rows of studs inscribed in different diameters. This translation allows the studs to be positioned for blocking the bayonet connection.

In other cases, the insertion steps correspond to a combined motion comprising a first stage of translation, followed by a first rotation, then a second translation. These are relative motions between the locking ring and the connector element concerned. It is for example the case when the series of studs concerned comprises a plurality of rows of studs inscribed in identical diameters. The first two relative motions allow to pass a first row of studs. The last translation step allows the studs to be positioned for blocking the bayonet connection.

According to an embodiment of the invention, where several pins are mounted to cooperate with the studs of the first connector element, and where the first and the third series of studs comprise two rows of studs inscribed in different diameters, and the second and fourth series of studs comprise two rows of studs inscribed in different diameters, the method can comprise the following steps:

a) inserting the locking ring into the first connector element, by means of a single translation, b) inserting the removable pins into the first connector element, c) inserting the second connector element into the locking ring, by means of a single translation, and d) locking the locking ring by rotating the locking ring.

Furthermore, the present invention relates to a method of disassembling two riser sections assembled by means of a connector according to the invention. This method can comprise the following steps:

a) unlocking the locking ring by rotating the locking ring, this single rotation unlocks the two connector elements that can have relative motions with respect to the locking ring, b) removing the second connector element from the locking ring, thus the second connector element is extracted from the locking ring while the first connector element is unlocked but translationally blocked in the locking ring, notably by at least one removable pin, c) removing at least one removable pin from the locking ring, thus the first connector element is positioned in the locking ring while being unlocked and moving freely, and d) removing the locking ring from the first connector element, thus the first connector element is extracted from the locking ring.

For step a), upon unlocking, rotation of the ring releases the respective cooperation of the first and third series of studs, and of the second and fourth series of studs. The rotation enabling simultaneous unlocking of the two bayonet type connections is a rotation by an angle corresponding to the angular range of the studs. For example, if the angular range of the studs is 36°, the unlocking rotation is a 36° rotation.

The removal steps consist in extracting the connector element concerned from the locking ring, from a position where the connector element is positioned in the locking ring.

In some cases, the removal steps correspond to a single relative translational motion of the ring with respect to the connector element. This is for example the case when the series of studs concerned only comprises one row of studs, or when the series of studs concerned comprises a plurality of rows of studs inscribed in different diameters. This translation allows the studs to be released from the bayonet connection.

In other cases, the removal steps correspond to a combined motion comprising a first stage of translation, followed by a first rotation, then a second translation. These are relative motions between the locking ring and the connector element concerned. It is for example the case when the series of studs concerned comprises a plurality of studs inscribed in identical diameters. The first translation step allows the studs of the second series of studs to be disengaged. The last two relative motions allow to pass a first row of studs.

According to an embodiment of the invention, where several pins are mounted to cooperate with the studs of the first connector element, and where the first and the third series of studs comprise two rows of studs inscribed in different diameters, and the second and fourth series of studs comprise two rows of studs inscribed in different diameters, the method comprises the following steps:

a) unlocking the locking ring by rotating the locking ring, b) removing the second connector element from the locking ring with a single motion of translation, c) removing the removable pins in the locking ring, and d) removing the locking ring from the first connector element, by a single motion of translation.

Figure 5:
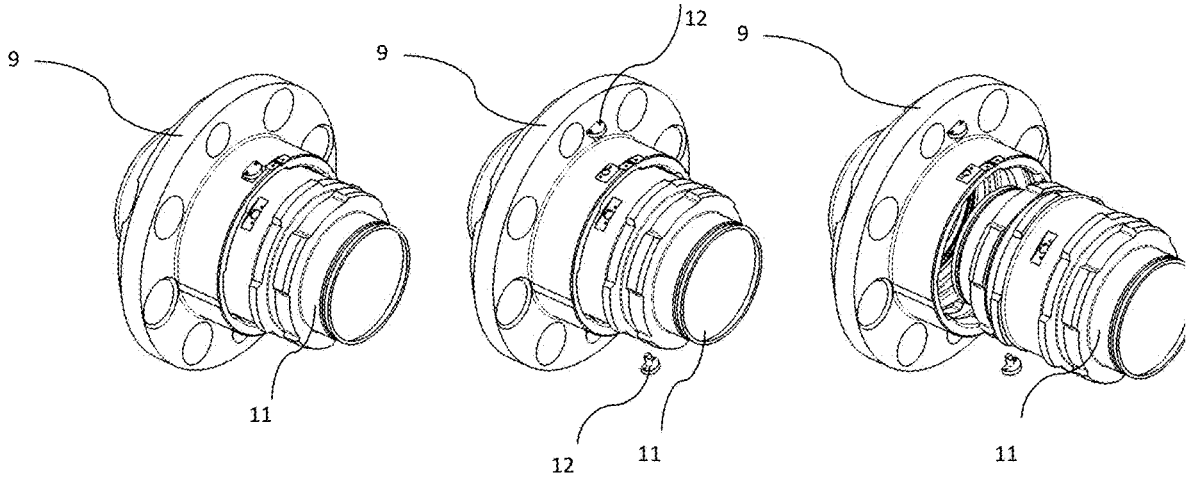
FIG. 5 illustrates steps of unlocking a connector according to an embodiment of the invention.

FIG. 5 schematically illustrates, by way of non-limitative example, steps of the method of disassembling two riser sections. FIG. 5 corresponds to steps c) and d) of the disassembling method. Initially (left-hand figure), locking ring 11 is kept in translation in first connector element 8 by means of removable pins 12. Then (central figure) pins 12 are removed so as to allow (right-hand figure) to remove locking ring 11 by axial translation of connector element 8.

The device according to the invention provides an attractive solution for rapidly and simply mounting a riser whose tension forces are distributed among the auxiliary tube elements and the main tube. Indeed, connection of one riser section to another riser section is achieved in a single operation through rotation of the locking ring. This connection allows to communicate and to seal the main tube element of a section with that of the other section and, simultaneously, to communicate and to seal the auxiliary line elements of one of the sections with those of the other section.

For the embodiment where the riser comprises at least one auxiliary line, the compact connector according to the invention allows to minimize the bending stresses in the flanges, and thus to reduce the dimensions of the flanges and to reduce the weight of the connectors. Besides, positioning the ring between the main tube element and the auxiliary tube elements allows to increase the strength of the connector. Indeed, the ring holds the flanges and prevents bending thereof. Moreover, this positioning allows to solve the problem of auxiliary line fittings interference because the bending moments caused by offset axial forces have unlike signs. Furthermore, in locked position, the studs of the ring are engaged with the studs of the second connector element that are positioned on the massive part of the second connector element.

The invention claimed is:

1. A connector for assembling two sections of a riser, comprising:

a locking ring rotatable between a locked position and an unlocked position, an outer surface of the locking ring comprising a first series of studs and a second series of studs, a first main tube element extended by a first connector element, an inner surface of the first connector element comprising a third series of studs, a second main tube element extended by a second connector element, an inner surface of the second connector element respectively comprising a fourth series of studs, wherein the third series of studs cooperates with the first series of studs, and the fourth series of studs cooperates with the second series of studs for connecting the first and second main tube elements by the locking ring, and at least one removable pin, the removable pin having an inserted position in which it is arranged in the first connector and has a projecting portion projecting from the inner surface of the first connector element that cooperates with a stud of the first series of studs of the locking ring in an unlocked position of the locking ring so as to translationally block the locking ring with respect to the first connector element by having the projecting portion contact the stud of the first series of studs of the locking ring.

2. A connector as claimed in claim 1, wherein the locking ring is centered in the first and second connector elements by means of a first and a second centering surface respectively provided on the locking ring.

3. A connector as claimed in claim 2, wherein the connector comprises no sleeve fastened to one of the first or second connector element.

4. A connector as claimed in claim 2, wherein the locking ring comprises a first and a second sealing surface respectively arranged in the first and second connector elements.

5. A connector as claimed in claim 2, wherein the inside diameter of the locking ring is substantially identical to the inside diameter of the first and second main tube elements.

6. A connector as claimed in claim 1, wherein the connector comprises a cylindrical sleeve mounted in first connector element.

7. A connector as claimed in claim 6, wherein the cylindrical sleeve comprises a bearing surface in contact with one end of the locking ring.

8. A connector as claimed in claim 1, wherein the locking ring is symmetrical with respect to a median plane of the locking ring perpendicular to the axis of the locking ring.

9. A connector as claimed in claim 1, wherein the removable pin comprises a plane surface for cooperating with the stud of the first series of studs of the locking ring.

10. A connector as claimed in claim 1, wherein the removable pin is arranged in an orifice of the first connector element.

11. A connector as claimed in claim 1, wherein the removable pin comprises a guide lug.

12. A connector as claimed in claim 1, wherein the connector comprises means for rotationally blocking the locking ring.

13. A connector as claimed in claim 12, wherein the means for rotationally blocking the locking ring comprise a system with an index pin, the index pin being preferably radial or axial.

14. A connector as claimed in claim 1, wherein the connector comprises means for rotationally blocking the first and second connector elements.

15. A connector as claimed in claim 14, wherein the means for rotationally blocking the first and second connector elements comprise two stops on each connector element, a stop of a connector element cooperating with a stop of the other connector element.

16. A connector as claimed in claim 13, wherein the index pin of the means for rotationally blocking locking ring is included in a stop of the means for rotationally blocking the first and second connector elements.

17. A connector as claimed in claim 1, wherein the studs of the first and second series of studs project over identical angular ranges.

18. A connector as claimed in claim 1, wherein the first and second connector elements are respectively provided with a flange for respective passage of a first and a second auxiliary tube element.

19. A riser comprising at least two sections of a riser assembled by a connector as claimed in claim 1.

20. A method for performing offshore well drilling or workover or production operations, comprising connecting a wellhead to a floater with the riser as claimed in claim 19.

* * * * *